US005593161A

United States Patent [19]

Boylan et al.

[11] Patent Number: 5,593,161

[45] Date of Patent: Jan. 14, 1997

[54] WAGERING GAME WITH A SET OF ROUNDS AND BETS

[75] Inventors: Eugene B. Boylan, Minden; Robert F. Koerner, Gardnerville; Russell R. Hebert, Carson City, all of Nev.

[73] Assignee: Bet Technology, Inc., Carson City, Nev.

[21] Appl. No.: 567,575

[22] Filed: Dec. 5, 1995

[51] Int. Cl.[6] ..... A63F 1/00

[52] U.S. Cl. ..... 273/274; 273/292

[58] Field of Search ..... 273/274, 292, 273/309, 85 CP

[56] References Cited

U.S. PATENT DOCUMENTS

| | | | |
|---|---|---|---|
| 5,098,107 | 3/1992 | Boylan et al. . | |
| 5,248,142 | 9/1993 | Breeding | 273/274 |
| 5,257,789 | 11/1993 | LeVasseur | 273/274 |
| 5,282,633 | 2/1994 | Boylan et al. . | |
| 5,328,189 | 7/1994 | Malek | 273/292 |
| 5,397,128 | 3/1995 | Hesse et al. | 372/292 |
| 5,417,430 | 3/1995 | Breeding | 273/274 |

OTHER PUBLICATIONS

"The Fresno Bee", Gaming . . . three blackjacks in a row, Nov. 10, 1992.

*Primary Examiner*—William M. Pierce
*Attorney, Agent, or Firm*—Larson and Taylor

[57] ABSTRACT

A method of playing a banking wagering game such as black jack includes the initial step of wagering a plurality of equal value first bets by each player against a banker/dealer. The number of first bets corresponds to a predetermined number of rounds of the wagering game constituting a set, such as three. Each respective first bet is a wager that the player will have a hand during the respective round which will win over a hand of the banker/dealer. As the first bets are made, each player also wagers a second bet of the same value as the first bets that each one of the first bets of the respective player during the set will be winning wagers. The predetermined number of rounds are then played to complete the set and determine the outcome of all bets. This playing step includes, after each round, the step of determining whether the respective first bet of each respective player is a winning or losing wager and the paying off or collecting of the first bet by the banker/dealer. In addition, the second bet of a respective player is collected after an initial collecting step of a losing first bet, or the second bet is paid off by the banker/dealer to a respective player after paying off of a winning first bet after a last round of the set where each first bet of each of the rounds of the set by the respective player has been a winning wager.

10 Claims, 1 Drawing Sheet

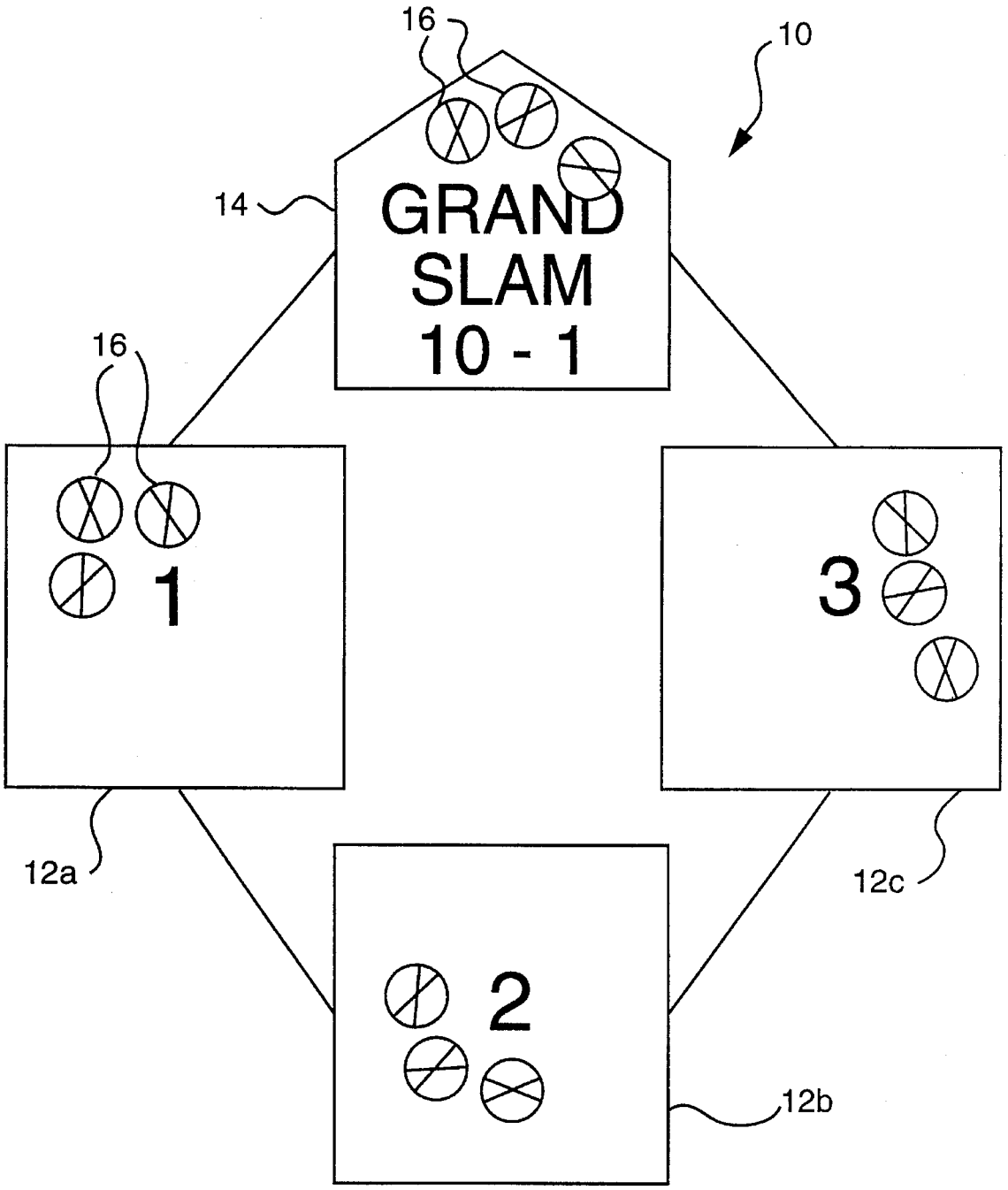
16
10
14
GRAND
SLAM
10 - 1
16
1
3
12a
12c
2
12b

WAGERING GAME WITH A SET OF ROUNDS AND BETS

FIELD OF THE INVENTION

The present invention relates generally to a banking wagering game, and more particularly to a banking wagering game in which a plurality of first bets are made together with a second bet at the beginning of a set of rounds of the wagering game.

BACKGROUND OF THE INVENTION

Typically in banking wagering games, a single wager is made at the beginning of each round of the game. Additional wagers can also be made, such as disclosed in U.S. Pat. Nos. 5,098,107 (Boylan) and 5,283,633 (Boylan), or as well known in popular games such as black jack or 21. These additional wagers are designed to add interest to the game and profitability to the casino (or other banker), but such additional wagers do tend to slow the play of the game.

SUMMARY OF THE INVENTION

In accordance with the present invention, a method of playing a banking wagering game, such as black jack or 21, is provided. The method includes the initial step of wagering a plurality of first bets by each player participating in the wagering game against a banker representing the casino or bank and also acting as a dealer (hereafter banker/dealer). The number of the plurality of first bets of each respective player corresponds to a predetermined number of rounds of the wagering game constituting a set, such as three. Each respective first bet is a wager that the respective player will have a hand during the respective round which will win over a hand of the banker/dealer. In addition to the first bets, each player also wagers a second bet at the same time as the plurality of first bets are made. The second bet is a wager that each one of the plurality of first bets of the respective player during the set will be winning wagers.

After the first and second bets are made, the predetermined number of rounds of the wagering game are played to complete the set. This playing step includes the step of determining, by the banker/dealer and after each respective round, whether the respective first bet of each respective player is a winning or losing wager. The banker/dealer then pays off each winning first bet to the respective player and collects each losing first bet after each determining step. In addition, the second bet of a respective player is collected after an initial collecting step of a losing first bet of the respective player is performed. Finally, the second bet is paid off by the banker/dealer to a respective player after paying off of a winning first bet after a last round of the set where each first bet of each one of the rounds by the respective player has been a winning wager.

In a preferred embodiment, the wagering steps include the making by each player of the first bets and the second bet which are all of the same value. In addition, the playing step includes the step of dealing playing cards by the banker/dealer to each player and to the banker/dealer himself to constitute the hands during each round. Further, the paying off of each winning first bet step includes the step of paying off at a first predetermined odds, and the paying off of each winning second bet step includes the step of paying off at a second predetermined odds which is greater than the first predetermined odds.

It is an object of the present invention to provide a game of chance which generates increased interest and participation.

It is also an object of the present invention to provide a wagering game with increased opportunities to wager.

It is a further object of the present invention to provide a wagering game which achieves the above-noted objects and in addition is simple and easily understood as an addition to a familiar wagering game.

Other features and advantages of the present invention are stated in or apparent from detailed descriptions of presently preferred embodiments of the invention found hereinbelow.

BRIEF DESCRIPTION OF THE DRAWING

The single figure is a schematic depiction of a display surface for the wagers made by a player in accordance with the present invention.

DETAILED DESCRIPTION OF THE PREFERRED EMBODIMENTS

With reference now to the drawing in which like numerals represent like elements, a display surface 10 is depicted which is used as part of the method of play of a banking (either house/casino sponsored or player banked) wagering game such as black jack or 21, baccarat, or like games. A respective display surface 10 is typically provided in front of or adjacent to each player of the wagering game other than the banker/dealer for the use of that player, with a plurality of such display surfaces 10 preferably provided at spaced interval on a table on which the wagering game is played. Display surface 10 includes first betting areas 12*a*, 12*b*, and 12*c*. First betting areas 12*a*, 12*b*, and 12*c* are used to place a suitable first bet for three different rounds of play of the wagering game, which three rounds constitute a set of the wagering game. First betting areas 12*a*, 12*b*, and 12*c* are each suitably identified with indicia "1", "2", and "3" which indicate which round of play the bets are placed for. Display surface 10 also includes a second betting area 14 which is used to place a suitable second bet as explained subsequently. It will be appreciated that each bet is made using suitable tokens 16 or the like which are placed in the first betting areas 12*a*, 12*b*, 12*c*, and 14 as shown.

The method of play of the wagering game of the present invention is explained subsequently with reference to the game of black jack which is notoriously well known in the art and used by almost all casinos and the like. Such games are played with a plurality of players (up to six or seven), with each player wagering against the house/casino (or banker/dealer) which is represented by (or acts as) a dealer of the playing cards used in the black jack game. However, it will be appreciated that the method of play is useful with a variety of games of chance of this sort where the same or similar objectives are desired.

The initial step of the banking wagering game is the wagering by each player participating in the wagering game of a plurality of first bets. This wager is made against the banker/dealer, and is physically made by placing a desired number of tokens 16 in the appropriate first betting areas 12*a*, 12*b*, and 12*c*. It will be appreciated that each first bet must be made with the same number or value of tokens 16, so that the banker/dealer can easily keep track of the wagers of each player. However, each individual player can chose to wager whatever number of tokens is desired as long as this conforms with the rules of the casino, or banker/dealer, or as previously agreed by all of the players. Typically for casino wagering games, both a minimum and a maximum wager is set by the casino for that table. Alternately, the casino or banker/dealer could require that only a set number of tokens 16 be used for each first bet to simplify the wagering step for the players.

The number of first bets and hence of first betting areas 12*a*, 12*b*, and 12*c* corresponds to a predetermined number of rounds of the black jack game to be played, and this number of rounds represents a set of the wagering game. Thus, in the presently discussed embodiment, there is three betting areas 12*a*, 12*b*, and 12*c* so that the predetermined number of rounds of the black jack game to be played to constitute a set is three. Each first bet is thus a wager that the respective player will have a hand during the round of play of the black jack game which will win over a hand of the banker/dealer.

At the same time that the first bets are placed at the beginning of a set, a second bet is also made by each player by placing the desired number of tokens 16 in second betting area 14. This second bet is a wager that each one of the plurality of first bets made by that player in the upcoming set will be a winning wager. In other words, the second bet is a wager that the player will win the three hands of the upcoming set against the three hands of the banker/dealer. It will be appreciated that the second bet is made with the same number of tokens 16 as the first bets for simplicity and to avoid confusion.

Once all of the first and second bets of all of the players have been made, the banker/dealer commences a round of play by dealing each player two up cards (cards whose faces are showing) and by dealing himself an up card and a down card (a card whose face is not showing). Depending on the point totals of the two cards dealt to each player and the value of the up card dealt to the banker/dealer, each player may elect to "stand" or take one or more "hit" cards in an attempt to reach a total score which will not exceed twenty-one but which will exceed that of the banker/dealer after the banker/dealer performs a similar process (not the same process because, typically in a casino game, the banker/dealer is required to receive a hit card until the total of the banker/dealer's hand is 17 or more). Of course, a total score of over twenty-one is an automatic losing hand for the player (and banker/dealer, but not until other players may have lost by exceeding the twenty-one total).

After the playing of a round, including the playing of the banker/dealer's hand, the banker/dealer determines whether each player has won or lost compared to the banker/dealer's hand and the rules of the wagering game. Where the player has won, the banker/dealer pays off the winning first bet at odds which are predetermined by the casino or banker/dealer. Where the player has lost, the banker/dealer simply collects the losing bet from the betting area 12*a*, 12*b*, or 12*c* associated with that round. This process continues for all three rounds of the wagering game constituting the set, so it will be appreciated that there is no separate betting performed prior to each hand so that play is speeded up.

It will also be appreciated that after each determining step, where the player has lost a first bet for the first time and thus has lost the second bet, the banker/dealer simultaneously collects the second bet from betting area 14 as the first bet is collected from the associated betting area 12*a*, 12*b*, or 12*c*. This action by the banker/dealer removes the second bet from sight as soon as it is no longer possible for the player to win the second bet, and this is done contemporaneously with the collecting of the losing first bet so that there is no question that both bets should be collected. Obviously, if the second bet is still present when the last (third) hand of the set is played and the player wins the first bet of that last (third) hand, the player has also won the second bet. At that time, the banker/dealer then pays off both the first bet and the second bet. Typically, the second bet is paid off at some odds which are greater than those of the first bet, as it is much less likely that the player will win a second bet.

The precise pay offs or odds for winning first bets and second bets are determined by the banker/dealer, subject to any government regulations and the various rules of play of the game determined by the casino or banker/dealer. For example, in the presently preferred method of play, the odds for winning of a first bet are even while those of the second bet are 10:1 (which is also indicated by indicia in second betting area 14). In addition, casino or banker/dealer rules allow a player with a two-card total of twenty-one to be declared an automatic winner (regardless of the banker/dealer's total) and paid off at 1.5:1. Otherwise, if the player and banker/dealer have the same total, the hand is declared a tie and the first bet is carried over to the next hand ("pushed") while the second bet is considered a losing bet (i.e., a tie is not considered a winning hand for the player insofar as the second bet is concerned). Other casino or banker/dealer rules are also possible, such as affording the player the opportunity to "split" any pair (but split aces only receive one card each) or "double down" (with a two card total of ten or eleven). Of course, each split or double down also requires the placing of an additional or matching first bet.

After the wager(s) of the last player are paid off or collected, the process is repeated beginning with each player placing a set of three first bets and one second bet all of the same value. With the disclosed method of playing a wagering game, a wagering game which is both quickly played and easy to understand is provided. In addition, the wagering game produces an additional (second) bet which increases the take of the banker/dealer (assuming proper odds are given) without adding any significant additional time to the play of the wagering game.

While the present invention has been described with respect to exemplary embodiments thereof, it will be understood by those of ordinary skill in the art that variations and modifications can be effected within the scope and spirit of the invention. For example, rather than a live action game between one or more players and a banker/dealer, the method of playing the wagering game could be incorporated into a video game which stands in place of the banker/dealer (and which is sponsored by the casino/house).

We claim:

1. A method of wagering in a banking type wagering game comprising the steps of:

a. selecting a wagering game having rules to be played as well as a predetermined number of rounds of the wagering game which is designated as a set, b. providing a wagering area for each player for a plurality of first bets and for a second bet, wherein the number of first bets corresponds to the predetermined number of rounds in the set, c. playing the predetermined number of rounds of the wagering game to complete the set, said playing step including the steps of:

i. each player wagering a plurality of first bets and a second bet, ii. playing a round of the selected wagering game and determining whether a respective first bet of each respective player is a winning or a losing wager according to the rules of the selected wagering game, (1) if the first bet is a winning bet, then paying off the first bet according to a first predetermined odds and commencing a subsequent round by repeating step ii if the number of rounds already played in the set does not equal the predetermined number of rounds, (2) if the first bet is a losing wager, then collecting said respective first bet along with said second bet and commencing a subsequent round by repeating step ii if the number of rounds already played in the set does not equal the predetermined number of rounds, and iii. completing the set when the number of rounds equals the predetermined number of rounds and paying off the second bet at a second predetermined odds of any respective player who did not lose any rounds in the playing step ii such that said second bet was collected whereby the second bet is a wager that a respective player will win each round played in the set.

2. The method as in claim 1 wherein each player wagering in step i. includes having the first bets and the second bet be made such that they are all of the same value.

3. The method as in claim 1 wherein the number of rounds is three.

4. The method as in claim 1 wherein said selected wagering game is a card game.

5. The method as in claim 1 wherein the second predetermined odds are greater than the first predetermined odds.

6. The method as in claim 2 wherein the number of rounds is three.

7. The method as in claim 6 wherein said selected wagering game is a card game.

8. The method as in claim 7 wherein the second predetermined odds are greater than the first predetermined odds.

9. The method as in claim 1 wherein said selected wagering game is black jack or twenty-one.

10. The method as in claim 9 wherein the second predetermined odds are greater than the first predetermined odds.

* * * * *